United States Patent [19]

Franzmann

[11] 4,304,161

[45] Dec. 8, 1981

[54] DEVICE FOR THE MANUAL PLAYING OF ELECTRONIC MUSICAL INSTRUMENTS

[76] Inventor: Rainer Franzmann, Rehhagweg 9, 7800 Frieburg, Fed. Rep. of Germany

[21] Appl. No.: 20,203

[22] Filed: Mar. 13, 1979

[51] Int. Cl.[3] ..... G10H 1/00; G10H 3/06

[52] U.S. Cl. ..... 84/1.01; 84/1.17; 84/DIG. 7

[58] Field of Search ..... 84/1.01, 1.17, DIG. 7, 84/423, 424, 425

[56] References Cited

U.S. PATENT DOCUMENTS 4,078,464 3/1978 Sugiyama ..... 84/1.01

4,123,960 11/1978 Franzmann ..... 84/1.17

[30] Foreign Application Priority Data

Mar. 16, 1978 [DE] Fed. Rep. of Germany ..... 2811421

*Primary Examiner*—J. V. Truhe

*Assistant Examiner*—Forester W. Isen

*Attorney, Agent, or Firm*—Stonebraker, Shepard & Stephens

[57] ABSTRACT

Device for the manual playing of electronic musical instruments. Each manual has three groups of keys respectively arranged along three tilting bars, for operation by three fingers on one hand of the player. When a key is pressed at one end, it tilts the bar on which it is mounted in one direction, and one tone is produced. If the same key is pressed at the opposite end, it tilts the bar in the opposite direction, and a different tone is produced. Special control keys or action converters include a roll positioned so that it may be operated by the thumb of the same hand which is playing the keys. Rotation of the roll by the thumb produces one control signal affecting the sound issuing from the instrument, and axial motion of the roll by the thumb produces a different control signal. Other refinements and improvements are disclosed.

20 Claims, 6 Drawing Figures

DEVICE FOR THE MANUAL PLAYING OF ELECTRONIC MUSICAL INSTRUMENTS

BACKGROUND OF THE INVENTION

This invention relates to electronic musical instruments, where the various sounds or noises are produced by electronic means. The present invention is in the nature of a modification or improvement upon the construction disclosed in the present inventor's U.S. Pat. No. 4,123,960, granted Nov. 7, 1978, hereafter sometimes referred to as "the prior patent" or "the main patent."

The entire disclosure of said U.S. Pat. No. 4,123,960 is incorporated herein by reference, and the disclosure of the present application proceeds on the assumption that the reader is familiar with the disclosure of the prior patent, so that explanations and background information given in the prior patent need not be repeated here. It is emphasized, however, that as stated in the prior patent, the construction with which the present invention is concerned, like the construction of the prior patent, is concerned with the arrangement and mounting of the keys and other movable control units for operation by the player of the instrument, and is not concerned with the electronic circuitry or other electronic means for producing the sounds desired. In this connection, attention is directed especially to column 1 of the prior patent, lines 16–34, which apply equally to the present improved construction as to the basic patent.

The instrument has, in general, a console or desk-like structure having at least one and preferably two portions which may be called manuals, to be manipulated by the arm-hand-finger of the player, one manual being for the right hand and one for the left hand, if two are used. In the disclosure of this improved construction, details of only one manual are illustrated, for use by the right arm-hand-finger members of the player, it being understood that if a second manual is employed for use by the left arm-hand-finger members, this left manual will be a reverse duplicate or mirror-image duplicate of the right one.

In the use of the construction disclosed in the prior patent, it has been found in practice that the locations of some of the movable members are disadvantageous, and it is partly to correct the disadvantages which have become apparent, and partly to provide for improved control and movement that the present improved construction has been devised. In the present construction, the mechanical-electrical action converters are positioned for operation by the hand and fingers in such a way that as many different control signals as possible can be controlled synchronously.

It has turned out, from experience, that especially the main keys for the tone control, and the coupling plate (56 in the prior patent) for control of the medium volume of sound, and the turn-wing (43 in the prior patent) for the continuous or stepped control of the noise elements or sound making elements have disadvantages regarding their locational arrangement and mode of action in the construction disclosed in the prior patent. The present invention overcomes these disadvantages and improves the use of the action converters when playing. The term action converters is intended to refer to elements or mechanisms, such as electric switches or variable resistors, which produce an electrical or electronic response as a result of a mechanical movement.

According to the present invention, the main keys are mounted in rows on supporting bars which can be turned or tilted, and one or more action converters to be operated by the thumb of the player are mounted on the free end of an oscillating arm. The main keys with their bars serve mainly for control of the tone degrees, of the duration, of the muting, and further of the accent of the tone which is to be played. Two neighboring tone degrees of a tone scale are attached to (that is, controlled by) one main key, the main key being extended in the y-direction. These two tone degrees are controlled by the respective halves of the extended main key. The player can choose the desired tone degree by touching one end or the other of the main key.

When a main key is pressed at or near one end, the mounting bar on which this key is mounted will be turned or tilted in one direction on its tilt axis, which axis extends in the y-direction, toward and away from the player and perpendicular to the x-axis direction in which the keys are elongated. This will cause the production of a particular tone. If the player presses the same main key at or near its opposite end, this would turn or tilt the mounting bar on which the key is mounted in the opposite direction of tilt, and would produce a neighboring tone somewhat different from the one produced when the opposite end of the same key is pressed. In this way, the player can selectively produce slightly different tones from each of the main keys, depending upon which end of the key he chooses to press.

This turning or tilting action of the mounting bar, resulting from pressing one of the main keys at one side or the other side of the tilting axis of the bar, controls the group of tone degrees, the entry or input, and the accent. The accent of the tone, that is, its relative volume and/or timbre, is controlled through different pressures which are produced by the tipped bar against its stop block or limit member.

According to one feature of the invention, there are three tilting bars arranged side by side, each carrying a set of main keys, so that each of the three fingers of the hand of the player (forefinger, middle finger, and ring finger) can play on its own set of main keys, and may tip or tilt its set of main keys as desired. When the tempered tone scale is preferably used, the main keys on each one of these three bars may have the same tone degrees, and if this is done, it follows that any wanted tone degrees may be picked out alternatively by the forefinger, the middle finger, or the ring finger, every finger utilizing the keys on its own mounting bar. The multiple presence of tone degree renders possible advantageous fingering concerning the playing of single tone scales, tone repetition, and chords. Thus an important improvement in playing technique can be achieved.

Through the fact that the control of a group of tone degrees (left hand group or right hand group) and the control of the entry or production of the notes or sounds and of the accent is appropriated to a bar, a very simple and economical construction of the needed action converters is possible, because now it is not necessary to equip every main key with all of the different action converters for accomplishing all of these functions. Because the action converters for operation by the thumb are mounted on the end of the oscillating arm, it is guaranteed that the important action converters for operation by the thumb can be controlled without interruption even though the oscillating arm is moved. In the prior patent, the arrangement of the action converters on the console or trestle unit was such that the interval from one action converter to the other was permanently changed when the oscillating arm was moved upwardly and downwardly. That was found to be a great disadvantage when playing. That disadvantage is avoided in the improved construction of the present invention.

BRIEF DESCRIPTION OF THE DRAWINGS

The drawings illustrate a preferred embodiment of the present invention to such extent as may be necessary for an understanding thereof by those skilled in the art who are already familiar with the prior basic patent. It should be understood that the present drawings are to be considered in conjunction with the disclosure of the prior patent, as illustrations of modifications of certain parts of the prior construction.

DESCRIPTION OF THE PREFERRED EMBODIMENTS

Figure 1:
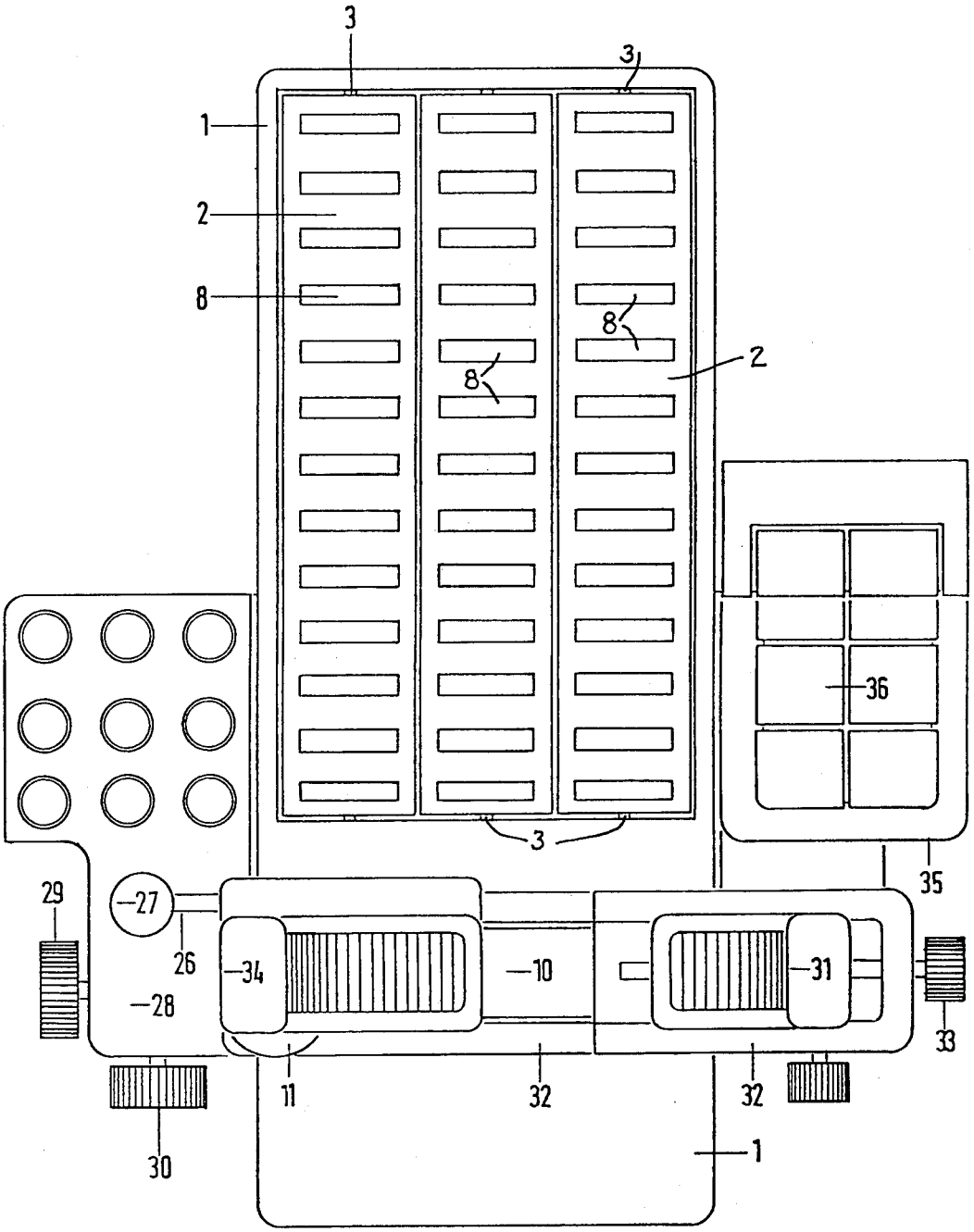
FIG. 1 is a top plan view of the right hand manual according to a preferred form of the improved design of the present invention.
Figure 2:
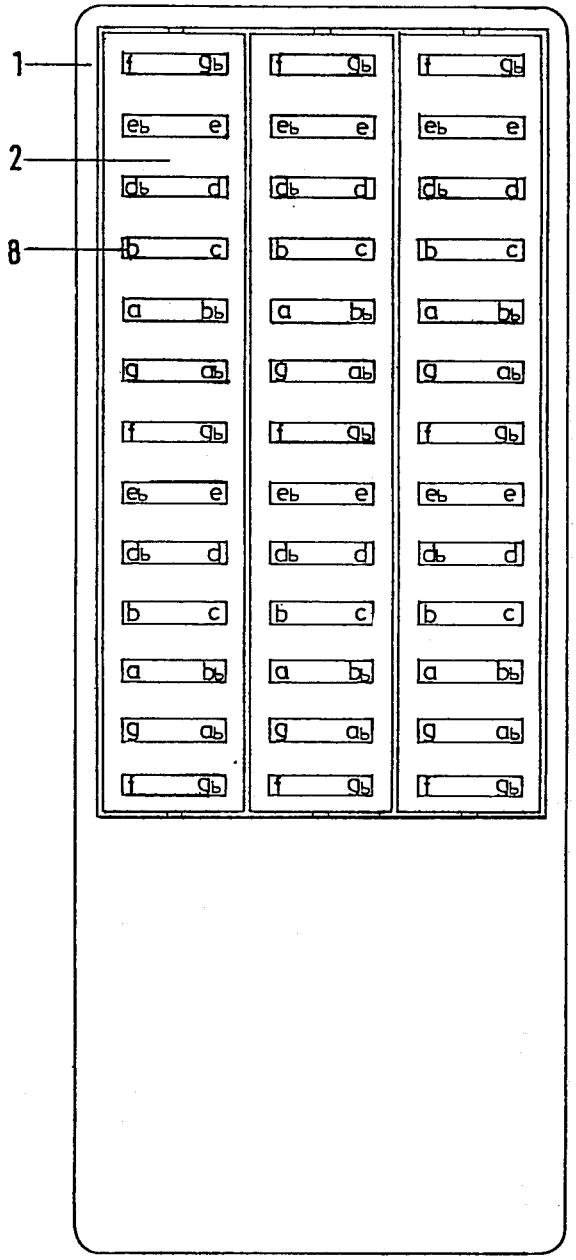
FIG. 2 is a top plan view of the main keys, with the names or note designations of the keys marked thereon.
Figure 3:
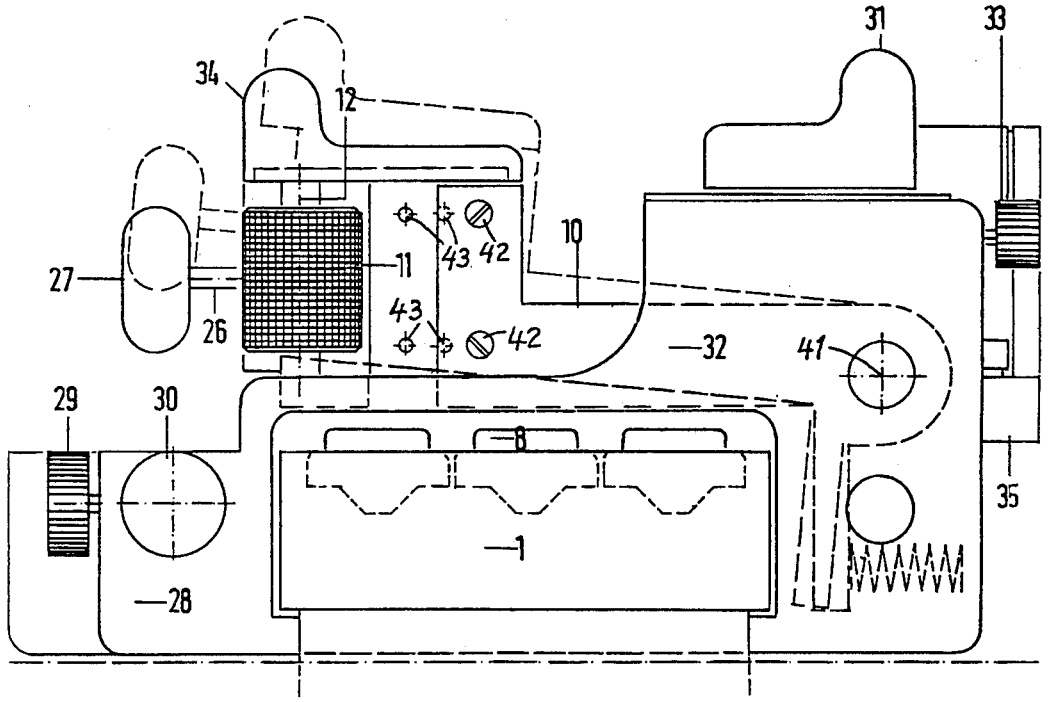
FIG. 3 is an end elevational view of the parts shown in FIG. 1.
Figure 4:
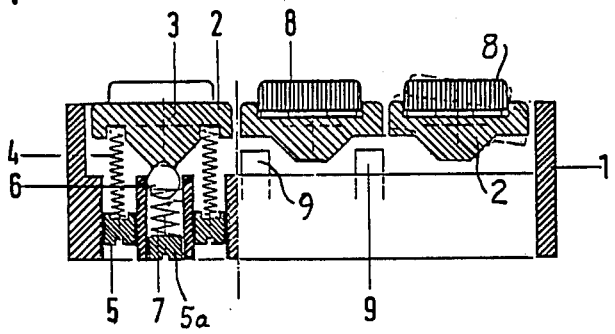
FIG. 4 is a somewhat schematic vertical section through the manual, with parts omitted, illustrating details of the main keys and the tilting bars on which they are mounted.

The improved manual illustrated in FIGS. 1–4 of the present drawings is intended to replace the manual illustrated in FIG. 3 of the drawings of the prior patent. Parts or features not specifically described in the present application may be the same as or similar to the corresponding parts in the prior patent.

The manual comprises a base frame unit 1, elongated in the direction of the y-axis (that is, toward and away from the player) and supporting three separate bars 2 each elongated in the same direction and placed in side by side relation (see FIG. 4 as well as FIGS. 1 and 2) and mounted on pivots 3 at their front and rear ends so that each bar may tilt sideways in either direction from a central position. These bars 2 are made of a light and sturdy material, for example light wood, or light metal such as aluminum, or molded plastic material. Their rotary axes defined by the pivots 3 extend in the y-direction, and the bars are held in normal horizontal position by springs 4 (see FIG. 4) which press upwardly on the undersides of the bars on opposite sides of the pivotal axes as illustrated, and which react downwardly against adjustable abutments in the form of screwplugs 5 screwed into the base frame 1. These springs 4 extend in the z-direction, that is, vertically, and there may be several springs or sets of right and left springs at various intervals along the length of each bar. Each bar is similarly equipped with springs, but for the sake of simplicity of the drawings, the springs are shown only in connection with one of the bars in FIG. 4.

To hold each bar in its normal flat or untilted position, each bar is provided with a click-stop device. For example, it may be provided by a click ball 6 pressed upwardly into a small recess in a bottom flange of the bar, by a spring 7, the tension of which can be trimmed by the adjustable screw-plug 5*a* similar to the screw-plugs 5 which adjust the tension of the springs 4. It is possible to omit the click-stop device, and rely upon the careful adjustment of the springs 4 to hold the bar in its flat or neutral position, but it is preferred to use the click-stop as an additional means to ensure correct neutral or normal positioning of the bar until it is purposely tilted in one direction or the other from this neutral position.

This click-stop device assures the precise normal position and a pull-off-like action when pressing down on the main keys 8 which are mounted on the tilting bar 2, which is a great advantage for the playing technique, because the motion of the bar can be controlled more precisely. Each bar 2 can be tilted or tipped to the right or to the left. The tilting or rotation will be stopped when the edge of the bar 2 touches the abutment or stop-block 9 (FIG. 4) which is preferably made of elastic rubber-like material so that no undesired noise will be produced by contact of the bar with the stop member. These stop blocks 9 are so placed that the rotation angle of the bar 2 is limited to a very small angle, so that the downward movement of the main keys 8 required to turn the bar is only a few millimeters. This small downward movement is advantageous when playing fast.

Each of the tiltable bars 2 carries a set of the main keys 8, arranged at equally spaced intervals along the length of the bar 2, that is, the keys are spaced from each other in the y-direction, and each key itself is elongated in a direction crosswise of the length of the bar on which it is mounted, that is, in the x-direction, as seen clearly in FIGS. 1 and 2. Each key is formed as a prism-like body having a rectangular top at an elevation above the top surface of the bar 2. The top surface of the key, which is touched by the fingers of the player, is elevated sufficiently high from the top of the bar so that if the player happens to have long fingernails, his fingernails do not touch the bar 2. The top surface of each key is made of plastic or similar material.

The proportions and spacing of the main keys represent a compromise between conflicting demands. The achievement of a precise and accurate touch by the fingers of the player requires larger intervals between the keys in the y-direction and also a great length of each key in the x-direction. On the other hand, the difficulty of fingering or touching great intervals, especially the fingering of chords, demands rather small intervals in the y-direction, and also makes it desirable to keep the dimensions in the x-direction rather small, to avoid a difficult spreading of the fingers. So a compromise must be reached.

Each of the three fingers used in playing the main keys 8, that is, the forefinger, the middle finger, and the ring finger, has its own bar 2 with an equal row of main keys 8. The main keys serve mainly the control of tone degrees. But after switching a special key provided for that purpose, the main keys may be used for the control and pre-set of tone timbre.

Every main key 8 represents two tone degrees, which can be controlled by touching the left or right half of the main key. The tone degrees are arranged successively in the y-direction from front to back. The tempered tone system is preferred as the most practicable system. The two tone degrees of each main key 8 differ from each other by one chromatic semitone, while the tone degrees from one main key to the next main key differ by two semitones or one whole tone.

In this preferred embodiment of the invention, the main keys on all three of the bars 2 have the same arrangement of tone degrees and the same electronic arrangement. For better understanding, the names or designations of the various tone degrees on the various keys are indicated in FIG. 2. In the example illustrated, the tone degree "C" is the preferred main normal tone. The entire set or assembly of main keys in this example represent a tone scale of about two octaves. The transgression or shift to higher or lower octaves can be accomplished through well known electronic circuits controlled by special keys.

The threefold presentation of every tone degree (that is, its production by pressing the proper key on any one of the three bars) and the ability to produce this tone degree by any one of the three fingers provides the same action range for each finger. This renders possible the use of the most advantageous fingering when playing a fast succession of tones, repetition of tones, and chords. The repetition of a tone may be played with two or three fingers. When playing successions of single tones, a permanent change between two or three fingers may be used. When fingering chords, every voice (tone) can be changed without deranging the others. To aid in visually distinguishing the main keys 8 from each other, the various keys for different tones may have different colors, or numbers, or codes or other indications.

While the preferred arrangement of the keys to the various tones is as above indicated, it is possible to use the main keys 8 for other tone systems. For instance, the two outer rows of main keys, on the two outer bars 2, may be arranged to produce notes or sounds according to the tempered scale system above mentioned, and the main keys of the middle row (those on the middle one of the tilting bars) may be used to produce tone degrees of quarter notes, dividing the octave through $24\sqrt{2}$. In this way, tone scales and chords with quarter tones may be easily played.

A second important function of the main keys 8 is the generation of a control signal for the muting process. This signal will be controlled or given when a main key is released, that is, when the pressure thereon is relieved. Another feature of these main keys is that all of the keys mounted on one bar have such electronic connections that only one main key can generate a control signal for the tone degrees. If two or more main keys on the same bar are touched or pressed at the same time, only the control signal of the key having the highest tone degree will be transmitted. Electronic circuits capable of such selection and transmissions are well known. Considering the simultaneous touching of the main keys for several different tone degrees on the same bar, one can say that the row of main keys on the bar is arranged for one voice.

If the muting process is interrupted through the well known control of the special key, a tone which has been played by touching a main key continues to sound even when the main key is let go or released. The special electronic circuit for the interruption of muting, which was switched on by the special key, takes over the continuance of the control signal for the tone degrees, and generates a muting signal for all tone degrees which had been taken over, only when this special key is released or set free. During the continuance of operation of this special circuit for interruption of muting, other main keys of the same bar can be controlled, whereby these additional tone degrees will be taken over also, thus getting on to sound generation and to the exit of the instrument. Considered from this standpoint, one may say that each row of main keys on a bar is arranged for several voices, although when considered from a different standpoint one may say that the row or main keys on a bar is arranged for only one voice, as already explained above.

Each of the main keys 8 has only two mechanical control positions, which may be described as "touched" and "not touched," or as "played" and "not played," or as "pressed" and "free" or by other similar means. They may be constructed as simple switches. They are preferably in the form of electronic touching switches or sensors, well known in the electronic art, which are switched to one condition when the surface is touched even very lightly, and which are switched to the other condition when all pressure is removed. In the "free" or "not touched" condition, the control signal for muting will be given, and in the "pressed" or "touched" condition, the control signal for the tone degree of that key may be switched and transmitted. When the bar 2 carrying the key which has been touched is turned or tilted to the left or right, the supplementary control signal to distinguish the left or right group of tone degrees will be switched. If digital coding is used, the twenty six tone degrees of a row of main keys on one bar may be coded with four bits concerning the main keys and with one bit concerning the bar. By controlling one bit of the whole tone degree address through the bar 2, the number of the touch switches 8 on one row can be reduced to half. Furthermore, the undesired simultaneous touch of both tone degrees on one main key is avoided.

The bars 2 serve for the control of the distinction of the tone degree groups, the control of the input or entry or attack, and the control of the accent. Control of the input or entry or attack means that only when a control signal for the entry or attack is present, the already chosen control signal for the tone degree (including the eventual sound or noise elements) will be switched and transmitted to the sound generating arrangements or equipment.

Each bar 2 has three mechanical control positions, the normal or intermediate position, and a position turned or tilted to the left, and a position turned or tilted to the right. In the normal position a control signal to block the entry or attack is switched. In the position turned to the left or turned to the right, a control signal for entry or attack will be switched. Controlling the entry by a bar is very advantageous, because a player can lightly touch the main keys without switching and transmitting a control signal for an entry or input of sound at the same moment. Only by further pressure sufficient to turn or tilt the bar to the left or to the right (that is, only in the case of a precise mechanical control) will the tone degree of one of the two groups (left or right) of tone degrees be switched and transmitted to the sound generating arrangements. The bars 2 are constructed with simple switches. If digital coding is used, the control positions normal or turned left or right may be coded with one bit.

The control of the accent, meaning preferably the continuous control of the relative volume and/or timbre of a tone, is preferably accomplished by turning or tipping the bar 2. From a mechanical standpoint, it is possible to control the accent either by the pressure used in turning the bar, or by the quickness or speed of turning. By reason of the fact that the angle of rotation of the bar is very small, as already mentioned above, it is preferred to use the factor of pressure. Therefore, each bar has associated with it two electronic components which change their electrical resistance continuously when there is a changing mechanical pressure on them. Such electronic components are well known. For example, they may be special conducting foam plastics, preferably mounted under the coating of the stop blocks or abutment blocks 9 (FIG. 4) which limit the turning of the bar 2. The degree of finger pressure used on one end or the other end of the key 8 in turning the bar 2 on which the key is mounted, will determine the degree of pressure exerted by the edge of the bar on the stop block 9, so that as greater or less pressure is used on the key, greater or less pressure will be applied to the variable resistor built into the abutment block 9. The control signal which will be produced as an analog change of voltage or current can be converted through a conventional known form of analog-to-digital converter, if digital control is desired. There is an important advantage in controlling the accent by means of the bars 2, in that the needed number of components for change of resistance for control of the accent can be greatly reduced. It is necessary to supply such components only for each bar, rather than for each one of the main keys.

According to their great importance for the control of changes in sound, the special action converters in the action range of the thumb are mounted on the free or swinging end of oscillating arm 10, thus taking part in moving upward and downward with the upward and downward motion of the oscillating arm. In this way, any permanent change of distance between the thumb and the action converters operated by the thumb is avoided. The action converters associated with the oscillating arm 10 preferably include an action converter for either continuous or stepped control of the sound or noise, especially in the phase of entry or attack, the action converter for the continuous control of formants or other changes of timbre, and at least the action converter for the control of the medium volume of sound from this manual.

For continuous control of the medium volume of the manual, a rotary member or roll 11 is mounted on the free end of the oscillating arm 10, to rotate on an axis which extends upwardly and downwardly in the z-direction. When rotating the roll 11 with the thumb, a control signal will be changed continuously, which will preferably serve the control of the medium volume from zero up to the maximum. The change of the control action can be accomplished through an electric adjustment resistor. In addition to rotating to perform this adjustment, the roll 11 can also be moved upwardly and downwardly in the z-direction along its rotation axis, and by such movement, another control signal is continuously changed, preferably serving to control the changing of formants or other timbres.

In the preferred construction, a frictional resistance is built into the roll to provide reasonable resistance against rotation, whereas the straight up and down movement has very low resistance, and the roll is held in a normal middle height position by light springs. The change of the control actions can be accomplished over an electric adjustment resistor.

Figure 5:
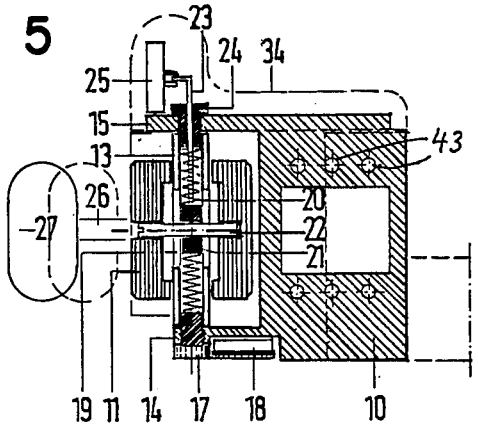
FIG. 5 is a vertical section through a rotary member or roll constituting an action converter.

As a preferred example of the physical construction, the roll 11 may be mounted on a hollow shaft 13 (FIG. 5) which is arranged to turn in bearings in a lower flange 14 and an upper flange 15 formed on the oscillating arm 10. The lower end of the shaft carries a pinion 17 which meshes with a gear 18 operating a rotary slider on a variable electrical resistor to produce the adjustment above described as occurring when the roll 11 is rotated.

The hollow shaft 13 has a longitudinal slot 19 through the middle part of its length. Two springs 20 located within the hollow shaft above and below a slide plug 21 tend to hold this slide plug at a central or normal height position. A pin 22 extends diametrically through a central hole in the plug 21 and through the longitudinal slot in the shaft 13, and the ends of the pin 22 are received in openings in the thickness of the roll 11. Thus when the rotary roll 11 is turned on its axis by the action of the thumb of the person playing the instrument, the turning of the roll is transmitted through the pin 22 to the hollow shaft 13, and this turns the pinion 17 and gear 18 to adjust the electrical resistor connected to the gear 18. In any turned position of the roll 11, the action of the player's thumb can also move the roll 11 upwardly or downwardly against the slight resistance offered by the springs 20. This upward or downward movement adjusts another resistance element, as for example by means of a rod 23 connected to the slide plug 21 and extending out the upper end of the hollow shaft, through an axial opening in the upper pivot bearing 24 on the flange 15. The upper end of the rod 23 operates a slider or other suitable adjusting element on an adjustable resistor 25, the resistance of which is thus varied by upward and downward movement of the roll 11 in order to accomplish the control above described as resulting from such upward or downward movement.

In an alternative construction, the roll 11 may be provided with a pressure type adjustable resistor arranged in one of the bearings of the roll. With such a construction, different pressures of the thumb on the roll will vary the resistance of the resistor and thereby change the control signal, either continuously or in steps as desired, depending upon the construction of the resistor and upon the design of the electronic circuitry in which the variable resistor is used.

Another control mounted on the free end of the oscillating arm 10 is in the form of a pusher rod 26 (FIGS. 1 and 3) which has bearings for a straight movement in the x-direction, in the oscillating arm. A spring holds it in normal position. When the thumb of the player pushes against a button or enlarged head 27 on the end of the rod 26, the rod is moved against its spring, and thus changes the resistance of an electrical adjustment resistor operatively connected to the push rod 26, to control either continuously or by steps the volume or other characteristics of the noises or sounds produced.

The sound elements of volume, formants, and timbres which are controlled by the above mentioned action converters are only preferred examples of operation. If desired, they may be interchanged with each other, so that what is here described as a control for volume, may be used as a control for formants, and what is described above as a control for timbres may be used as a control for volume, etc. The controls arranged as above described are, however, those which are preferred at present.

For a better understanding, it is pointed out that the roll 11 is a substitute for the coupling plate 56 in the prior patent, and the push rod 26 is substitute for the turn wing 43 in the prior patent. As already mentioned above, the coupling plate and the turn wing in the prior patent have been found in practice to be somewhat inconvenient, and the present improved construction is more convenient for playing.

The normal value of the control signals produced by operation of the roll 11 and the pusher rod 26 when they are in normal position, can be changed and regulated by rotary adjusting members or buttons 29 and 30, even while playing the instrument is in progress. These buttons 29 and 30, mounted on the console, are connected to variable resistors arranged in the electronic circuitry so as to vary or alter the control or change resulting from a given movement of the roll 11 and of the push rod 26, respectively.

For better controlling the upward and downward movements of the oscillating arm 10, in order to accomplish better the playing changes which result from such upward and downward movement, one improvement of the present invention as compared with the prior patent is that the clamp jaw 31 is not mounted on the oscillating arm but is mounted on the trestle unit 32. The position of the clamp jaw 31 can be adjusted in the x-direction by the adjusting screw 33, as before, although the mounting of the jaw is different. The second support for the hand of the player, that is, the clamp jaw 34, is mounted on the oscillating arm. It will be noted especially from FIG. 7 of the drawings of the prior patent that both of the clamping jaws 50 and 51 are mounted on the oscillating arm 49 of the prior patent. The result of this is that when the hand is placed between these clamping jaws, it has no fixed resting point. In the improved construction of the present invention, the placing of one clamping jaw 31 on the trestle 32, rather than on the oscillating arm, means that one edge of the player's hand rests on a fixed point so far as elevation is concerned, and gives the player better control over the other edge of his hand which is on the other jaw 34 (FIG. 3 of the present application) on the oscillating arm, thus enabling him to control the upward and downward oscillations of the arm more precisely.

In the preferred construction, the oscillating arm is made in two parts, and the free end of the arm, supporting the hand jaw 34 and the roll 11 and the push rod 26 is adjustable to some extend toward and away from the axis of oscillation 41 of the arm. This adjustment is made by removing the screws 42 and resetting them in other ones of the series of screwholes 43 provided for that purpose, in the telescopic portion of the oscillating arm 10. The adjustment of the jaw 31 by means of the adjusting screw 33 would ordinarily be sufficient, but if the player happens to have a hand which is unusually wide or unusually narrow, so that the adjustment by the screw 33 is not sufficient, then the further adjustment can be made by resetting the screws 42 as just mentioned.

Figure 6:
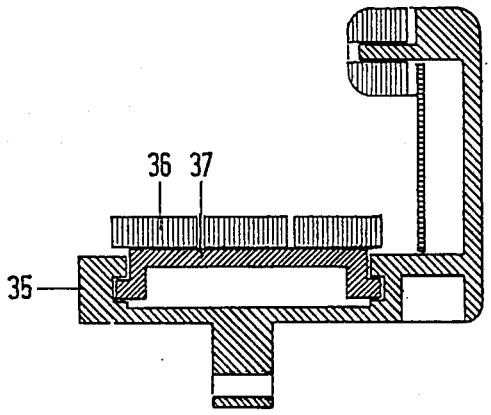
FIG. 6 is a schematic vertical section, with parts omitted, through a tablet and associated parts.

The tablet 35 (FIGS. 1, 3, and 6) supports a sliding carriage 37 (FIG. 6) which can be moved along its guideways in the x-direction, and which carries the special keys 36. The little finger of the player can push the carriage 37 and thus control a desired sound element operatively connected to the movement of the carriage 37. Preferably the movement of this carriage operates a control signal (by changing an electrical resistance) by which the exit curve of a tone can be controlled from an extremely short or quick cessation of sound up to a continuous sound.

In a modification of this construction, a pressure sensitive type of adjustment resistor is placed in the guideways of the sliding carriage 37, so that when the carriage is pressed in the y-direction by the little finger, a variable amount of pressure can be placed on the pressure sensitive resistor in the guideway, thereby producing the control signal.

It will be understood that if the digital coding is used, all analog control signals of action converters in the action range of the little finger may be converted into digital signals by known conversion techniques.

To render possible the smooth linear movement of the basic frame unit and the trestle unit and any other units movable relative to each other, ball bearings for linear movement may be used. Another possibility is to use roller type bearings which roll on guide rails and which have rubber or rubber-like coatings for reduction or elimination of noise.

It may be mentioned that the little finger tablet or console 35 corresponds in general to the little finger console 12 of the prior patent. Also the thumb console 28 and the trestle unit 32 correspond in general to the thumb console 13 and trestle unit 14 of the patent.

What is claimed is:

1. A device for manually playing an electronic musical instrument comprising (a) a plurality of bars each mounted for tilting movement about a tilt axis, (b) each of said bars having mounted thereon a plurality of operating keys in a row extending in the direction of the tilt axis of the bar on which they are mounted, (c) the row of keys on one bar being adapted to be operated by one finger of a hand of a player and the row of keys on a different bar being adapted to be operated by a different finger of the same hand.

2. The invention defined in claim 1, wherein each of said keys constitutes an action converter for affecting a sound output from said instrument as a result of being touched by a finger of the player, and wherein said tilting bars also constitute action converters for affecting said sound output as a result of being tilted.

3. The invention defined in claim 2, wherein there are three bars arranged in parallel side-by-side relation to each other and positioned so that the keys on the three bars may be played respectively by the forefinger, the middle finger, and the ring finger of the hand of a player.

4. The invention defined in claim 2, further comprising an additional action converter mounted in the vicinity of said tilting bars in such position that the thumb of a player's hand may operate said additional action converter while the fingers of the same hand are playing the keys on said tiling bars.

5. The invention defined in claim 1, wherein the rows of keys on at least two of said tilting bars represent the same tone degrees of a tone scale.

6. The invention defined in claim 1, wherein each of said keys on at least one of said tilting bars represents two tone degrees, and the particular tone degree which is effective when a key is operated is determined by the position of tilt of the bar on which that key is mounted.

7. The invention defined in claim 6, wherein the two tone degrees represented by the same key differ from each other by a semitone, and the tone degrees of one key differ from the tone degrees of the next adjacent key on the same bar by two semitones constituting one whole tone.

8. The invention defined in claim 6, wherein said one of said tilting bars has a neutral central position, and a leftwardly tilted position rendering effective one of the two tone degrees of any operated key on that tilting bar, and a rightwardly tilted position rendering effective the other of the two tone degrees of any operated key on that tilting bar.

9. The invention defined in claim 1, wherein said keys are formed as slender rectangular prisms projecting upwardly above the surface of the bars on which they are respectively mounted.

10. The invention defined in claim 9, wherein said keys are elongated in a direction crosswise of the tilt axis of the bar on which they are mounted to a sufficient extent so that pressing one end of a key will tilt the bar on which it is mounted in one direction and pressing the opposite end of the key will tilt the bar in the opposite direction.

11. The invention defined in claim 4, wherein said additional action converter comprises a roll mounted for rotation about a rotary axis by action of a thumb of a player.

12. The invention defined in claim 11, wherein said roll is mounted for axial movement in the direction of its rotary axis in addition to being rotatable, and wherein both its rotation movement and its axial movement act as action converters for affecting the sound output from said instrument.

13. The invention defined in claim 11, further comprising an upwardly and downwardly oscillating arm, said roll being mounted on a free end of said arm.

14. The invention defined in claim 13, further comprising a first hand rest at a substantially constant elevation for receiving one edge of a hand, and a second hand rest for receiving an opposite edge of the same hand, said second hand rest being mounted on said oscillating arm to move upwardly and downwardly therewith, said hand rests being so placed that when a hand is placed on said hand rests, the thumb of the hand may actuate said roll and the fingers of the hand may touch at least some of the keys on said tilting bars.

15. The invention defined in claim 13, further comprising a push rod mounted on a free end of said oscillating arm and adapted to be pushed manually during playing of the instrument, said rod constituting an action converter for affecting a sound output from said instrument.

16. The invention defined in claim 1, further comprising a sliding carriage in position to be moved by a finger of a hand whose fingers are also operating said keys on said tilting bars, at least a portion of movement of said carriage serving as an action converter for affecting a sound output from said instrument.

17. The invention defined in claim 1, wherein each of said tilting bars is elongated in a y-direction toward and away from a person facing and playing the instrument, and wherein each of said keys is elongated in an x-direction approximately perpendicular to said y-direction.

18. The invention defined in claim 1, further comprising a two-part hand rest on which the hand of a player may rest while the fingers of such hand play said keys on said tilting bars, one part of said hand rest for supporting one edge of the hand being substantially stationary during playing and a second part of the hand rest for engaging an opposite edge of the hand being movable in response to movements of the hand during playing.

19. A device for manually playing an electronic musical instrument comprising a first row of operating keys positioned to be selectively played by one finger of a player's hand, a second row of operating keys positioned to be selectively played by a different finger of the same hand of the player simultaneously with the playing of the keys of the first row, and an additional action converter in the form of a rotary member positioned to be moved by a thumb of said hand while two fingers of said hand are playing keys in said two rows, said rotary member being mounted for both rotary movement on an axis of rotation and axial movement along said axis, both movements being controlled by said thumb of said hand, and each row of keys being mounted on a separate tilting bar elongated in the direction of spacing of the keys in the row and mounted for tilting about a tilt axis extending in the direction of elongation.

20. The invention defined in claim 19, wherein each of said keys is elongated in a direction transverse to the direction of the tilt axis of the tilting bar on which it is mounted, and wherein pressure on one end of a key will tilt the bar on which it is mounted in one direction on its tilt axis and pressure on the opposite end of the key will tilt the bar in the opposite direction.

* * * * *